US005989767A

United States Patent [19]

Yoerger et al.

[11] Patent Number: 5,989,767

[45] Date of Patent: Nov. 23, 1999

[54] CARRIER PARTICLES FOR ELECTROSTATOGRAPHIC DEVELOPERS

[75] Inventors: William E. Yoerger, Rochester; Wayne T. Ferrar, Fairport, both of N.Y.

[73] Assignee: Eastman Kodak Company, Rochester, N.Y.

[21] Appl. No.: 09/212,065

[22] Filed: Dec. 15, 1998

[51] Int. Cl.[6] ..... G03G 13/22; G03G 9/10

[52] U.S. Cl. ..... 430/106.6; 430/108; 430/137

[58] Field of Search ..... 430/108, 137, 430/106.6

[56] References Cited

U.S. PATENT DOCUMENTS

| | | | |
|---|---|---|---|
| 4,027,073 | 5/1977 | Clark | 428/412 |
| 4,378,420 | 3/1983 | Gruber et al. | 430/120 |
| 4,920,023 | 4/1990 | Koch et al. | 430/126 |
| 4,977,054 | 12/1990 | Honjo et al. | 430/108 |
| 5,068,301 | 11/1991 | Okamura et al. | 528/15 |
| 5,171,653 | 12/1992 | Jugle et al. | 430/108 |
| 5,200,287 | 4/1993 | Ohnura et al. | 430/108 |
| 5,709,975 | 1/1998 | Yoerger et al. | 430/106.6 |
| 5,747,209 | 5/1998 | Takiguchi et al. | 430/106.6 |

*Primary Examiner*—John Goodrow
*Attorney, Agent, or Firm*—Doreen M. Wells

[57] ABSTRACT

Carrier particles for developers used in electrostatographic imaging processes such as electrophotography comprise core particles such as strontium ferrite having a coating that comprises a silicone resin admixed with an alkali metal salt of an organic acid. The novel carrier particles provide faster charging rates for toner, less toner throw-off and improved charge stability.

22 Claims, No Drawings

CARRIER PARTICLES FOR ELECTROSTATOGRAPHIC DEVELOPERS

FIELD OF THE INVENTION

This invention relates to carrier particles for electrostatographic dry developers and, more particularly, to carrier particles having a coating that improves the electrostatic charging of the toner particles of the developers.

BACKGROUND OF THE INVENTION

In electrostatography, image charge patterns are formed on a support and are developed by treatment with electrostatically charged marking particles which are attracted to the charge patterns. These particles are called toner particles or, collectively, toner. The image charge pattern, also referred to as an electrostatic latent image, is formed on an insulative surface of an electrostatographic element by any of a variety of methods. For example, the electrostatic latent image may be formed electrophotographically as in office copiers and laser printers, by imagewise photo-induced dissipation of portions of an electrostatic field of uniform strength on the surface of a photoconductive layer formed on an electrically conductive substrate. Alternatively, the electrostatic latent image may be formed by direct electrical formation of an electrostatic field pattern on a dielectric surface.

One well-known type of electrostatographic developer comprises a dry mixture of pigmented, thermoplastic toner particles in powder form and carrier particles. Developers of this type are employed in cascade and magnetic brush development processes. The toner particles and carrier particles differ triboelectrically, such that during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in image-wise pattern, to the latent image bearing surface. The resultant toner image can then be fixed, by application of heat or other known methods, or can be transferred to another surface and then fixed.

In such development methods the electrostatic attraction between the toner and carrier particles must be strong enough to hold the toner particles on the surfaces of the carrier particles while the developer is being transported to and brought into contact with the latent image, but when that contact occurs, the electrostatic attraction between the toner particles and the latent image must be even stronger, so that the toner particles are pulled away from the carrier particles and deposited on the latent image-bearing surface.

Carrier particles can comprise a metallic or non-metallic core material coated with a polymer. Carrier coating polymers that have heretofore been used include: silicone resin; acrylic polymers, such as, poly(methylmethacrylate); and vinyl polymers, such as polystyrene. One purpose of the coating can be to reduce the tendency of toner material or other developer additives to adhere permanently to carrier surfaces during developer use (often referred to as "scumming"). Another purpose has been to improve the charging characteristics of the carrier.

A problem encountered in the use of electrostatographic developers is "throw-off," which refers to toner powder thrown out of a developer mix as it is mechanically agitated within a development apparatus. Throw-off can cause unwanted background development in the image and contamination problems in the apparatus. Throw-off can increase as the developer is used, to such an extent that the developer must be replaced. A possible mechanism for this increase in throw-off is that the charging sites on the surface of the carrier particles become scummed. If the throw-off of the developer can be controlled so that it does not increase unduly over time, the developer will last longer and reduce the cost to the user.

Polymers that have been proposed heretofore as coatings for carriers include silicones, acrylic polymers, vinyl polymers and fluorocarbon polymers. Patents disclosing silicone polymer coatings for developer carriers or for other substrates include:

U.S. Pat. No. 5,068,301 which describes an organopolysiloxane coating composition for an electrophotographic carrier; U.S. Pat. No. 4,977,054 which discloses as the coating for a developer certain specific silicone resins; U.S. Pat. No. 5,200,287 which discloses a soft ferrite carrier core that is coated with a composition comprising a silicone resin and a carbon fluoride; Japanese patent publication 6/266169 which discloses a carrier for a negative developer which has a soft ferrite core (copper zinc ferrite) and a silicone coating with hydrophilic silica particles; Japanese patent publications JP 59232362, JP 02210365 and JP 01191155 disclosing soft ferrite carrier particles coated with a filled silicone resin; and U.S. Pat. No. 4,027,073 which discloses the use of silsesquioxanes as abrasion resistant coatings for substrates such as acrylic lenses.

There is a need for carriers for dry developers having an improved combination of properties, such as greater charge stability of the toner, faster charging rate, low toner throw off and improved R.H. stability for the toner charge. The cited references fail to disclose developer carriers having the coatings that characterize the carriers of the invention and that provide the desired improved combination of properties.

SUMMARY OF THE INVENTION

In accordance with the invention, electrostatographic developer carrier particles having the desired combination of properties comprise a carrier core and coated on the core a silicone polymer admixed with an alkali metal salt of an organic acid. The invention further includes the method of preparing such carrier particles and developer compositions containing them.

The carrier particles of the invention offer the important advantage of rapid charging of toner, low amount of toner throw-off, stable toner charging and improved charge stability with change in ambient humidity (R.H. stability).

DETAILED DESCRIPTION

The carrier cores for the coated carriers of the invention can be selected from a wide range of particulate materials that can be coated and admixed with electrostatographic toner particles for triboelectric charging of the toner particles. Thus, carrier core particles can include magnetic particles for use in magnetic brush development of electrostatic charge patterns as well as non-ferrous metallic particles and non-metallic particles such as ceramic or glass particles for other methods of development. Preferred carriers for electrostatographic dry developers useful in magnetic brush development are hard or soft ferrites but, especially, hard ferrites as disclosed in Yoerger and Ferrar U.S. Pat. No. 5,709,975, which is incorporated herein by reference. Excellent results with the carriers of the invention are obtained when the carrier core particles are strontium ferrite particles. Element iron particles such as sponge iron particles also are useful as carrier core particles.

In accordance with the invention the carrier core is coated with a crosslinked silicone resin that is admixed with an alkali metal salt of an organic acid or a hydrate thereof.

The silicone resin preferably is prepared in a manner similar to the preparation of a silsesquioxane. The coating comprises primarily silsesquioxane. Silsesquioxanes are a class or inorganic/organic glasses which can be formed at moderate temperatures by a type of procedure commonly referred to as a "sol-gel" process, silicon alkoxides are hydrolyzed in an appropriate solvent, forming the "sol"; then the solvent is removed resulting in a condensation and the formation of a cross-linked gel. A variety of solvents can be used. Aqueous, aqueous-alcoholic, and alcoholic solutions are generally preferred. Silsesquioxanes are conveniently coated from acidic alcohols, since the silicic acid form $RSi(OH)_3$ can be stable in solution for months at ambient conditions. The extent of condensation is related to the amount of curing a sample receives, with temperature and time being among the two most important variables.

The prefix "sesqui-" refers to a one and one-half stoichiometry of oxygen and the "siloxane" indicates a silicon based material. Silsesquioxane can thus be represented by the general structure: $(RSiO_{1.5})_n$ where R is an organic group and n represents the number of repeating units. This formula, which is sometimes written $\{Si(O_{1/2})_3R\}_n$ is a useful shorthand for silsesquioxanes; but, except as to fully cured silsesquioxane, does not fully characterize the material. This is important, since silsesquioxanes can be utilized in an incompletely cured state.

To form the silicone resin of the coating composition, preferably one or more reactant silanes are mixed, hydrolyzed and cured. The silanes preferably have the structural formula:

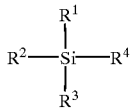

wherein $R^1$, $R^2$, $R^3$, and $R^4$ are independently selected hydrolyzable or non-hydrolyzable moieties with the proviso that at least 70%, more preferably at least 85% and most preferably at least 90% of the total number of the silanes have three hydrolyzable moieties to form the desired polysilsesquioxane and the remaining silanes have at least one hydrolyzable moiety. More preferably, less than 5% of the total number of the silanes in the reactant mixture have only one hydrolyzable moiety. Preferably, less than 30%, more preferably less than 20% of the total number of the silanes in the reactant mixture have two hydrolyzable moieties. It is also preferred that less than 5% of the total number of the silanes used to form the silicone resin have four hydrolyzable moieties. Further, it is preferred that the silanes that are used to form the silicone resin have a weight average molecular weight of 32 to 500, more preferably 50 to 350. Although not presently preferred, a small percentage of silicon atoms in the silanes, for example less than 20%, can be replaced by another metal, such as aluminum, titanium, zirconium, or tin, and mixed with silanes to form the silicone resin.

Hydrolyzable moieties are moieties which cleave from a silicon atom in an aqueous solution, and include alkoxides, halogens, acetoxy, oxime, hydrogen and the like. The preferred hydrolyzable moieties are methoxy, ethoxy, and chlorine.

Non-hydrolyzable moieties are moieties which do not cleave from a silicon atom in an aqueous solution and are not capable of participation in a siloxane polycondensation reaction. Non-hydrolyzable moieties can be aromatic or nonaromatic moieties preferably having from 1 to about 12 carbons. The following monovalent or divalent moieties are examples of suitable non-hydrolyzable moieties: alkyl preferably having from 1 to about 12 carbons, haloalkyl, preferably fluoroalkyl, preferably having from 1 to about 12 carbons, cycloalkyl preferably having a single, 5 or 6 membered ring and aryl ring systems preferably having a single 5 or 6 membered ring and from 5 to 12 carbons, including carbons of any substituents. Monovalent moieties are bonded to the Si atom of a single subunit of the polysilsesquioxane. Divalent moieties are bonded to the Si atoms of two subunits. The average number of carbons in non-hydrolyzable moieties is preferably 1 or greater, for example, non-hydrolyzable moieties can be a mixture of methyl and one or more other moieties. Specific examples of monovalent non-hydrolyzable moieties are: methyl, ethyl, n-propyl, isopropyl, n-butyl, isobutyl, t-butyl, n-decyl, perfluorooctyl, cyclohexyl, phenyl, dimethylphenyl, benzyl, napthyl, and trimethylsiloxy. Examples of divalent non-hydrolyzable moieties are di-substituted alkyls and di-substituted phenyls.

Other non-hydrolyzable moieties include heteroatoms and organofunctional moieties, with the proviso that the heteroatoms are not bonded directly to the silicon atom, but are linked through methylene units to the silicon atom. Generally these organic moieties have oxygen, nitrogen and sulfur, and a total of carbons and heteroatoms from about 4 to about 20. Many non-hydrolyzable moieties include one of the following moieties: oxy, thio, ester, keto, imino, and amino. Suitable non-hydrolyzable moieties include neutral rings and chains of ethylene oxides and propylene oxides and tetramethylene oxides and ethylene imines and alkylene sulfides, glycidoxy ethers, epoxides, pyrolidinones, amino alcohols, amines, carboxylic acids and the conjugate salts, sulfonic acids and the conjugate salts.

The preferred non-hydrolyzable moieties are methyl, ethyl, and phenyl. The most preferred non-hydrolyzable moiety is methyl.

Examples of useful silanes which can be used singly or in mixtures for making the silicone resins of this invention include alkytrialkoxysilanes, such as, methyltrimethoxysilane, ethyltrimethoxysilane, propyltrimethoxysilane, butyltrimethoxysilane, isobutyltrimethoxysilane, methyltriethoxysilane, ethyltriethoxysilane, propyltriethoxysilane, butyltriethoxysilane, iso-butyltriethoxysilane, and methyltributoxysilane; dialkyldiakoxysilanes, such as, dimethyldimethoxysilane, and dimethyldiethoxysilane; trialkyalkoxysilanes, such as, trimethylmethoxysilane and trimethylethoxysilane; tetraalkoxysilanes, such as tetraethylorthosilicate, and tetramethylorthosilicate; aryltrialkoxysilanes, such as phenyltrimethoxysilane, and phenyltriethoxysilane, and halosilanes, such as, tetrachlorosilane, methyltrichlorosilane, dichlorodimethylsilane, and chlorotrimethylsilane. The more preferred silanes are methyltrimethoxysilane, dimethyldimethoxysilane, dimethyldiethoxysilane, and methyltriethoxysilane. The hydrolyzable or non-hydrolyzable moieties can be the same or different on each silane or in the silane reactant mixture.

In a preferred embodiment, the silanes used to form the silicone resin comprise 70% or more of methyltrimethoxysilane and the balance 30% or less of dimethyldimethoxysilane by total weight of the silanes used to form the silicone resin.

The hydrolized silane is made by combining the reactants, that is the silanes, used to make the silicone resin, and adding an acid to the reactant mixture to acidify the mixture to a pH preferably less than 5, more preferably 1.5 and 4. Water is then added to the mixture to hydrolyze the silanes.

In addition to the described silicone resin, the coating compositions for the carrier particles of the invention contain alkali metal (Li, Na, K, Rb or Cs) salts of organic acids, including monobasic and polybasic carboxylic acids and sulfonic acids. The preferred acids are aliphatic monocarboxylic acids of from 1 to 8 carbon atoms, e.g., formic, acetic, propionic and the like. Suitable polybasic acids include: Dicarboxylic acids of from 1–8 carbons, e.g., oxalic, maleic, malonic, fumaric, succinic, and glutaric etc., the mono and di substituted salts thereof and the hydrides thereof. Also useful are hydroxyl substituted acids, e.g., glycolic, lactic and malic; amino acids, e.g., glycine, glutamic, and ethylenediaminetetraacetic; keto acids, e.g., acetylacetonates and their hydrates; aromatic acids, e.g., benzoic, phthalic, terephthalic, benzenesulfonic, toluenesulfonic, benzenedisulfonic, mono and di substituted salts thereof and polymeric acids, e.g., polyacrylic acid, polymethacrylic acid, polyvinylchlorendate, polystyrenesulfonic acid, and copolymers with maleic acid, and polyvinylsulfate.

The acid salts can be added directly to the coating solution (preferably after predissolving in a suitable solvent or mixture thereof), or can be created in situ if, as in the case of alkoxysilanes, the resin is prepared by hydrolysis with water and an organic acid (preferably formic, acetic, propionic, oxalic, malonic, maleic, malic or the like). A small portion of the acid can be converted to the desired alkali metal salt through the subsequent addition of a base, e.g., LiOH, NaOH or KOH or carbonates thereof, e.g., $Na_2CO_3$ or $K_2CO_3$, without severely changing the pH of the solution. It can also be created in situ if a colloidal silica, stabilized with an alkali metal oxide, eg., sodium oxide, potassium oxide or the like is added to the acidic resin solution. Any one of the above or combinations thereof can be incorporated into the carrier coating.

U.S. Pat. No. 4,027,073 to Clark, which is incorporated herein by reference, discloses a transparent, abrasion resistant coating composition for substrates such as acrylic panels and lenses. The coating compositions are formed by adding trialkoxysilanes to acidic aqueous dispersions of colloidal silica. The patent states that alkali metal salts of carboxylic acids can catalyze condensation of the hydrolyzed silane. It further states that certain commercially available colloidal silica dispersions contain free alkali metal base which reacts with the organic acid used for adjustment of pH to generate carboxylate catalysts in situ. The Clark patent offers no suggestion of using such compositions to coat electrostatographic carrier particles. However, as indicated above, in preparing the carrier composition of the present invention, the alkali metal salt of an organic acid can be formed in situ by adding to the acid-hydrolyzed alkoxy silane solution an alkali metal oxide alone or in admixture with silica that contains such an alkali metal compound. In either case, the resulting compositions can be used to coat carrier cores and provide the improved charging properties that characterize the compositions of the invention.

The addition of the alkali metal salt to the silicone precursor composition, i.e., the hydrolyzed alkoxy silane solution, has several advantages including the fact that the alkali metal compound catalyzes the condensation reaction of the hydrolyzed silane compounds. It should be understood, however, that the carrier compositions of the invention can also be formed by admixing a preformed silsesquioxane silicone resin with an alkali metal salt of an organic acid. This can be done advantageously by dissolving commercially available silsesquioxane silicone flakes in a solvent such as methanol and mixing the alkali metal salt with the silicone solution.

In the carrier coating compositions of the invention, the silicone resin is present in the range of about 50% to 100% by weight of the total weight of the solids (not including the acid salt) in the coating composition (assuming complete hydrolysis of the hydrolyzable silanes), and the alkali metal acid salt is present in the range of about 0.01 wt. % to about 8%, preferably about 0.1% to about 4% of the resin content of the coating composition.

In examples, hereinafter, and in the tables recording the results of such examples it will be seen that for comparison purposes the concentrations of different alkali metal salts and other additives were selected to provide equimolar concentrations with respect to sodium acetate. However, it should be understood that optimum concentrations for salts of dicarboxylic acids and the like are more advantageously concentrations that are equinormal rather than equimolar with respect to the optimum weight concentrations of monocarboxylic salts. Thus, salts containing e.g., three or more sodium atoms when used at the equimolar concentrations that are optimum for mon-acid salts will improve the charging rate in accordance with the invention but may increase the humidity sensitivity or lower the fresh charge. By using such salts of di- or tri- at lower molar concentrations than those of the mono-acid salts, i.e., at equinormal concentrations, the same superiority in all properties of the carrier is obtained.

The silicone coating can also contain other additives, e.g., release agents, such as stearic acid; humectants such as polyethylene glycol; adhesion promoters; catalysts and the like.

The carrier cores, such as ferrite particles, are coated by mixing with a solution or suspension of the coating composition. This mixture of carrier core particles and coating composition is preferably stirred in a stream of warm air to dry the coating on the surfaces of the core particles. The coating is then allowed to cure further at elevated temperature. The amount of solids in the coating composition depends on the final desired amount of dry coating on the cores, and the weight of the cores added to the coating composition. The amount of solvent in the coating composition should be enough to thoroughly wet the carrier particles. Alternatively, the coating can be applied using a fluidized bed, by spray coating or other techniques known in the art. For these methods, the amount of solvent needed for the coating composition can be determined by routine experimentation.

The weight percent of the dry coating composition on the cores is based on the weight of the cores and is typically within the range of about 0.5 to about 4.0 weight %. The preferred amount will be determined by the surface area of the specific core particles that are used. If the surface area is high, higher amounts of the coating can be used. Conversely, if the surface area of the core particles is low, lower amounts of the coating should be used. The preferred amount is about 0.5 to 2.5 % by weight of the cores, using a core having a BET (standard measurement of surface area in $m^2/g$) of about 2000. The coating can be a continuous or discontinuous layer on the cores.

The coated carrier particles of this invention are used in a developer which consists of the carrier particles and toner.

The carrier particles are preferably 80 to 99% by weight of the developer, and the toner is preferably 1 to 20% by weight of the developer. Useful mixing devices include roll mills, auger mixers, and other high energy mixing devices. Preferably the coated carrier particles are used with electronegatively charging toners. Usually, carrier particles are larger than toner particles. The carrier particles preferably have a particle size from about 5 to about 1200 micrometers, more preferably from 20 to 200 micrometers. The toner preferably has a particle size of 2 to 30 micrometers, preferably from 3 to 15 micrometers.

The terms "particle size", "size", or "sized" as used herein in reference to the "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The coated carrier particles can be used with any toners to make developers. Toners typically comprise at least a thermoplastic polymer binder. Useful toner binder polymers include thermoplastic vinyl polymers, such as homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkylacrylates, methacrylates, or butadiene. Fusible styrene-acrylic copolymers which are covalently lightly crosslinked with a divinyl compound such as divinylbenzene, as disclosed in U.S. Pat. No. Re. 31,072, are particularly useful.

Another useful binder polymer composition comprises:

a) a copolymer of a vinyl aromatic monomer; a second monomer selected from the group consisting of i) conjugated diene monomers and ii) acrylate monomers selected from the group consisting of alkyl acrylate monomers and alkyl methacrylate monomers; and b) the acid form of an amino acid soap which is the salt of an alkyl sarcosine having an alkyl group which contains from about 10 to about 20 carbon atoms. Binder polymer compositions of this type having a third monomer which is a crosslinking agent are described in U.S. Provisional application Ser. No. 60/001,632 entitled TONER COMPOSITIONS INCLUDING CROSSLINKED POLYMER BINDERS and filed in the names of Tyagi et al. Binders of this type not having a third monomer which is a crosslinking agent are made in accordance with the process described in U.S. Pat. No. 5,247,034 except that the copolymer includes a crosslinking agent.

Binder materials for the toner particles used with the carriers of this invention can be amorphous or semicrystalline polymers. The amorphous toner binder compositions have a Tg in the range of about 45° C. to 120° C., and often about 50° C. to 70° C. The useful semi-crystalline polymers have a Tm in the range of about 50° C. to 150° C. and more preferably 60° C. to 125° C. The thermal characteristics, such as Tg and Tm, can be determined by any conventional method, e.g., differential scanning calorimetry (DSC).

Although as discussed above, the carrier compositions of the invention can be used with a wide range of toner compositions, they are most useful with insulative toners, i.e., toners having a non-conductive binder resin. Especially useful toners of this kind are those having, for example, a styrene-acrylic or a styrene-butadiene binder polymer. With such insulative resins the charging properties of the carriers of the invention are particularly outstanding.

Colorant materials, i.e., dyestuffs or pigments, can be employed in the toner particles for the developers of the invention. Such materials serve to color the toner and/or render it more visible. Toners can be prepared without colorant material to form a developed toner image of low optical densities. When a colorant is used, the colorant can be selected from virtually any of the compounds mentioned in the Colour Index volumes 1 and 2, Second Edition. Suitable colorants include those typically employed in cyan, magenta and yellow colored toners. Such dyes and pigments are disclosed, for example, in U.S. Pat. No. Re. 31,072 and in U.S. Pat. Nos. 4,160,644; 4,416,965, 4,141,152; and 2,229,513. One particularly useful colorant for toners to be used in black and white electrostatographic copying machines and printers is carbon black. The amount of colorant may vary over a wide range, for example, from about 1 to 40 percent of he weight of binder polymer used in the toner particles. Mixtures of colorants an also be used.

Another optional component of the toner composition is a charge control agent. The term "charge control" refers to a propensity of a toner addendum to modify the triboelectric charging properties of the resulting toner. A wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553, all of said patents being incorporated herein by reference. Mixtures of charge control agents can also be used.

Another component which can be present in the toner composition is an aliphatic amide or aliphatic acid as described in *Practical Organic Chemistry*, Arthur I. Vogel, 3rd Ed. John Wiley and Sons, Inc. N.Y. (1962); and *Thermoplastic Additives: Theory and Practice*, John T. Lutz Jr. Ed., Marcel Dekker, Inc. N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ethylene bis(oleamide), ethylene bis(stearamide), ethylene bis(behenamide) and long chain acids including stearic, lauric, montanic, behenic, oleic and tall oil acids. Particularly preferred aliphatic amides and acids include stearamide, erucamide, ethylene bis-stearmide and stearic acid. The aliphatic amide or aliphatic acid is present in an amount from about 0.5 to 30 percent by weight, preferably from about 0.5 to 8 percent by weight. Mixtures of aliphatic amides and aliphatic acids can also be used. One useful stearamide is commercially available from Witco Corporation as KEMAMIDE S. A useful stearic acid is available from Witco Corporation as HYSTERENE 9718.

The toner can also contain other additives, including magnetic pigments, leveling agents, surfactants, stabilizers, and the like. The total quantity of such additives can vary. A present preference is to employ not more than about 10 weight percent of such additives on a total toner powder composition weight basis. Toners can optionally incorporate a small quantity of low surface energy material, as described in U.S. Pat. Nos. 4,517,272 and 4,758,491.

The toner compositions useful with the carrier particles of the invention can be made with a process that is a modification of the evaporative limited coalescence process described in U.S. Pat. No. 4,883,060, the disclosure of which is hereby incorporated by reference. Alternatively, the toners can be commercially obtained from Eastman Kodak Co. and other toner manufacturers.

The toner can also be surface treated with small inorganic particles to impart powder flow or cleaning or improved transfer. Toners having transfer assisting addenda are commercially available from Ricoh, Cannon and other toner manufacturers or can be produced by the numerous methods disclosed in the prior art.

Developers of the invention containing the coated carriers of the invention and a toner can be mixed by any known toning station to triboelectrically charge the toner. For magnetic development with a developer comprising a magnetic coated carrier, it is preferred to use a rotating-core magnetic applicator which comprises a core-shell arrangement to apply the toner to an electrophotographic element. The core of the applicator is a multipolar magnetic core, meaning that it comprises a circumferential array of magnets disposed in a north-south-north-south polar configuration facing radially outward. The core is rotatably housed within the outer shell. The shell is composed of a nonmagnetizeable material which serves as the carrying surface for the developer composition. As the core rotates in the shell, the two component developer rapidly flips due to the rotating magnets in the core. Magnetic applicators having a rotating core are further described in U.S. Pat. Nos. 4,235,194; 4,239,845 and 3,552,355, incorporated herein by reference.

The preparation of specific compositions of the invention and the coating and testing of carriers of the invention and of comparison carriers have been carried out as described below:

Preparation and Testing of Carriers

The silicone resin was prepared by stirring 10 cc. of methyltrimethoxysilane with 1.1 cc. of dimethyldimethoxysilane and 0.5 cc. of glacial acetic acid. To this was added with good stirring, 4 cc. of distilled water. An exothermic hydrolysis reaction promptly took place. The solution was stirred for one hour and then the dope was allowed to stand overnight before use. To 50 g. of strontium ferrite carrier core particles of 25 to 30 $\mu$m average particle size was added the hydrolyzed silane (~2.05 g.) dissolved in 14–15 cc. of methanol. The final solution contained 1 g. of resin. To this was either added nothing (for comparative samples) or, for carrier particles of the invention, an amount of alkali metal salt of an organic acid (~1 cc.), from a concentrate which had been predissolved in ~10 cc. of either distilled water or methanol or a mixture of each. The silicone solution was mixed with the ferrite particles in a stream of warm air to evaporate the solvent. When a dry powder was obtained; the sample was cured for two hours at 230° C. The sample was then allowed to cool and was sieved to break up any agglomerates.

The carriers were magnetized to saturation by placing them in a Model 595 High Power-Magnetreater/Charger manufactured by RFL Industries Inc. For testing, the magnetized silicone-coated carrier particle samples were mixed at 12% toner concentration (T.C.) with a negative charging toner to make a developer composition. The toner consisted of 6 pph. Regal™ 300 carbon, available from Cabot Corp., 2 pph charge agent (CCA 7 charge agent available from ICI), and 100 pph styrene, butylacrylate-divinylbenzene (77/23/0.3) copolymer, the toner average particle size being about 11–12 $\mu$m.

Toner charge was measured in microcoulombs per gram ($\mu$Coul./g) in a "MECCA" device for two exercise time periods designated in the tables hereinafter as "Fresh Q/m" and 10 min Q/m". Prior to measuring the toner charge, the developer was vigorously shaken (exercised) to cause triboelectric charging by placing a 4 gram sample of developer (3.52 grams carrier, 0.48 grams toner) into a 4 dram glass screw cap vial, capping the vial and shaking the vial on a "wrist-action" robot shaker operated at about 2 Hertz and an overall amplitude of about 11 cm for 3 minutes. Toner charge level after shaking was then measured by placing a 100 milligram sample of the charge developer in a MECCA and measuring the charge and mass of the transferred toner in the MECCA. This measurement was made by the MECCA by placing the 100 milligram sample of the charged developer in a sample dish between electrode plates. The sample was subjected for 30 seconds, simultaneously to a potential of 2,000 Volts across the plates, and to a 60 Hz magnetic field with caused the developer to agitate. The toner was released from the carrier and was attracted to and collected on the plate having polarity opposite to the toner charge. The total toner charge was measured by an electrometer connected to the plate, and that value was divided by the weight of the toner on the plate to yield the charge per mass of the toner (Q/m). This measurement is "Fresh Q/m".

The 3 min Q/m, 10 min Q/m, and Admix Dust Test were measured for carrier subject to two aging periods: (a) no aging and (b) 16 hours "overnight" (O.N.). The measurements for carrier that was not aged were performed as described above.

MECCA charges (30 sec.) were measured on a mixture of 3.52 g. of carrier and 0.48 g. of toner (in a 4 dram glass screw cap vial) after the samples were shaken for three min. and then magnetized.

The developer samples were then exercised for 10 min. by placing the magnetized developer, in the 4 dram vial, on top of a rotating magnetic brush (2000 rpm's; core rotation only; the bottle being held in place). This treatment causes the developer to turn and exercise as if it were directly on a magnetic brush but without any loss of toner from possible dusting, as it is all contained in the vial. The 30 sec. MECCA charge is then reread at the end of 10 min. exercise. This test is the "10 Min. Ex. Q/M" recorded in the tables hereinafter.

The next test was the "Admix Dust" test. After the 10 min. Ex. Q/M was determined, enough fresh toner was added to the remainder of the developer to bring the final concentration of the developer to 18 wt. % toner. The developer sample was stirred slightly to mix (about 15 light turns with a spatula) and then shaken for 15 sec. and poured onto a small magnetic brush and exercised for one minute at 2000 rpm's. A Buchner funnel with a preweighed piece of filter paper was held in place by a slight vacuum over the top of the rotating brush and any toner dust that is thrown off was collected and weighed, (the results are recorded in mg./sample). This 15 sec. Admix Dust test, recorded in the tables hereinafter, simulates what would happen in a copier in which high toner throughput would require the addition of fresh toner which, if the toner charging rate is not fast enough, will cause dusting.

In some tests a fresh sample of 5.28 g. of magnetized carrier was shaken with 0.72 g. of toner (in a 4 dram screw cap vial) and then exercised as above, but for 16 hrs. of unreplenished aging. At the end of the 16 hrs.; the carrier was electrically stripped in a 5.5 Kv. field of essentially all of the exercised toner. Then 3.52 g. of stripped carrier was shaken for 3 min. with 0.48 g. of fresh toner, and the MECCA charge of the fresh sample and the 10 min. exercised samples were read. The 15 sec. Admix dust test was also run. The amount of Admix dust throw off is sensitive to humidity and increases at low R.H. with the toner used in these tests. Therefore, the carriers of the invention were compared with the control at the same humidity.

Humidity Sensitivity Testing

The humidity sensitivity of the carriers was measured by taking 3.6 g. of magnetized carrier and 0.4 g. of negative charging toner consisting of 2.5 pph Hodogaya T-77 charge agent, 7 pph. Black Pearls 420 carbon supplied by Cabot Corp. and 100 pph. styrene-butylacrylate-divinylbenzene (80/20/0.3) copolymer and allowing the sample to stand, open to the atmosphere, for ~16 hrs. in a humidity chamber at R.H. levels of ~10%, ~50%, and ~80%. The sample was then placed in a 4 dram, screw cap vial and shaken for three minutes. This was then exercised on top of a rotating magnetic brush (as above) for 10 min., and the 30 sec.

MECCA read. The difference in the extremes for charge to mass ratio (Q/M) over the humidity range 10–80% R.H. for the toner that was exercised for 10 minutes (10 min. Ex.) is recorded in Table 1 as ΔQ (in μcoul.).

The following Examples 1–9 and Tables 1–9 identify the samples tested and record the test results for developer mixtures initially containing 12 wt. % toner, and prepared and tested as described above. In Tables 1–9, the carrier identified as "control" differed from the carriers of the invention in that no alkali metal compound was added to the hydrolyzed silane polymer with which the strontium ferrite carrier cores were coated. In each of the examples of the invention, the silicone coating on the strontium ferrite core particles contained an alkali metal salt of an organic acid, the latter being identified in Tables 1–9 in the column entitled "Additive". As will be noted, certain comparison samples contained a coating additive that was not an alkali metal salt of an organic acid.

EXAMPLE 1

A silicone resin was prepared as above and coated at 2 pph. on strontium ferrite carrier and cured. For samples 192-2. 192-3 and 192-4 sodium acetate was added to the coating composition in the concentrations shown in Table 1 to determine the effect on the admix dust and R.H. sensitivity as compared with the control carrier for which the coating was the same silicone resin but without sodium acetate. The additive amounts are in weight % based on the amount of silicone resin. The tests in the example and in Examples 2–4, 6 and 7, other than the 10%–80% RH tests, were run at ambient humidity of 20–25% RH. Table 1 records the test results.

TABLE 1

| Sample # & Additive | Fresh Q/M | 10 Min. Ex. Q/M | 15 Sec. Admix Dust 12%–18% T.C. (mg) | 10% R.H.–80% R.H. ΔQ (μ Coul.) |
|---|---|---|---|---|
| 192–1 (Control) | −23.3 | −30.1 | 14.8 | 8.8 |
| 192–2 0.075% Na Acetate | −24.9 | −26.1 | 8.8 | |
| 192–3 0.15% Na Acetate | −25.6 | −27.5 | 6.3 | 9.3 |
| 192–4 0.3% Na Acetate | −25.6 | −27.6 | 6.1 | 8.8 |
| 192–5 & 0.6% Na Acetate | −26 | −27.4 | 5.3 | 6.6 |

The data in Table 1 show that the carrier compositions of the invention (192-2, 192-3, 192-4 and 192-5) showed stable change levels, i.e., Q/M of the fresh developer and of the developer after 10 minutes of exercising showed little change but the charge level changed substantially in the test of the control carrier. In the admix dust test the carriers of the invention produced much less admix dust (throw-off).

EXAMPLE 2

Carriers having coatings of silicone with added alkali metal salts of formic acid or acetic acid were prepared as in Example 1 and tested in comparison with carriers having silicone coatings containing a quaternary ammonium salt, namely, tetramethyl ammonium acetate or ammonium formate. Table 2 records the test results.

TABLE 2

| Sample # & Additive | Fresh Q/M | 10 Min. Ex. Q/M | 15 Sec. Admix Dust 12%–18% T.C. (mg) | 10% R.H.–80% R.H. ΔQ (μCoul.) |
|---|---|---|---|---|
| 192–1 Control | −23.3 | −30.1 | 14.8 | 8.8 |
| 192–5 0.6% Na Acetate | −26.6 | −27.4 | 5.3 | 6.6 |
| 1–4 0.72% K Acetate* | −17.8 | −17.5 | 4.5 | 5 |
| 6–7 0.6% Tetramethylammonium Acetate | −27.6 | −26.4 | 12 | 10.3 |
| 4–2 0.5% Li Formate.H2O* | −18.2 | −21.5 | 5 | 2.9 |
| 4–3 | −18.3 | −19.9 | 3.4 | 4.3 |

TABLE 2-continued

| Sample # & Additive | Fresh Q/M | 10 Min. Ex. Q/M | 15 Sec. Admix Dust 12%–18% T.C. (mg) | 10% R.H.–80% R.H. ΔQ (μCoul.) |
|---|---|---|---|---|
| 0.61% K Formate* | | | | |
| 4.5 | −14.2 | −15.2 | 4.9 | 6.8 |
| 0.96% Rb Formate* | | | | |
| 4–6 | −8.8 | −13.4 | 6.2 | 7.4 |
| 0.46% 1.3Cs Formate* | | | | |
| 4–8 | −21.8 | −26.8 | 20.3 | 12.4 |
| 0.46% NH4 Formate | | | | |

*Equimolar to 0.6% Na Acetate

The data in Table 2 show that the carrier compositions of the invention showed markedly less change in charge to mass ratio (Q/M) than the control composition that contained no alkali metal salt of an organic acid. The admix dust was also much lower than for the control and the change in charge, with changing humidity (ΔQ) was less than or about the same as for the control. In comparison with the compositions containing ammonium salts (samples 6–7 and 4–8) the carriers of the invention showed much less admix dust and less change in Q/M over the 10 to 80% R.H. range.

EXAMPLE 3

In this example carriers of the invention, prepared as in Example 1 but containing alkali metal salts of acetylacetonate in the silicone coating, were compared with the control carrier.

TABLE 3

| Sample # & Additive | Fresh Q/M | 10 Min. Ex. Q/M | 15 Sec. Admix Dust 12%–18% T.C. (mg) | 10% R.H.–80% R.H. ΔQ (μCoul) |
|---|---|---|---|---|
| 18–1 (Control) | −23 | −29.6 | 15.2 | 8.8 |
| 18–2 | −21.3 | −28.5 | 10.1 | 4 |
| 0.78% Li Acetylacetonate* | | | | |
| 18–3 | −20.6 | −22.5 | 7.7 | 3 |
| 1.02% Na Acetylacetonate H2O* | | | | |
| 18–4 | −18.7 | −19.1 | 5.7 | 5 |
| 1.08% K Acetylacetonate ½ H2O* | | | | |

*Equimolar to 0.6% Na Acetate

Table 3 shows that all of the carriers of the invention had markedly lower ΔQ and lower admix dust (throw off) than the control carrier and those with the Na and K salts also were superior in change stability after exercising.

EXAMPLE 4

In this example carriers of the invention prepared as in Example 1 and in which the silicone coatings contained derivatives of either mono or di salts of dicarboxylic acids were tested in comparison with a control carrier of which the silicone coating contained no alkali metal salts of an organic acid. The results are recorded in Table 4.

TABLE 4

| Sample # & Additive | Fresh Q/M | 10 Min. Ex. Q/M | 15 Sec. Admix Dust 12%–18% T.C. (mg) | 10% R.H.–80% R.H. ΔQ (μ Coul) |
|---|---|---|---|---|
| 28–1 (Control) | −22.3 | −30.1 | 14.7 | 8.8 |
| 4–9 | −17.1 | −18.1 | 6.3 | 3.9 |
| 1.17% Di Na Maleate X H2O* | | | | |
| 19–2 | −16.1 | −17.4 | 7.4 | 4.2 |
| 1.13% Mono K Maleate* | | | | |
| 28–2 | −13.8 | −16.5 | 5.1 | 4.1 |
| 1.35% DiK Oxalate | | | | |
| 28–3 | −17.2 | −22.1 | 5.6 | 4.4 |
| 1.22% Di Na Malonate H2O* | | | | |
| 28–4 | −17.1 | −19.4 | 5.9 | 2.4 |
| 1.19% Di Na Succinate* | | | | |

*Equimolar to 0.6% Na Acetate

Table 4 shows that in comparison to the control carrier the carriers of the invention provided much less change of Q/M after exercising, markedly less admix dust and much lower ΔQ with humidity change.

EXAMPLE 5

In this example the tests were run at ambient humidity of 55% R.H. instead of 20–25% as in the previous four examples. As the control shows, the admix dust dropped considerably and required a 16 hr. (one overnight or O.N., as abbreviated in Table 5) exercise strip and rebuild to show the long term effects on improved charging rate.

As in previous examples, Table 6 shows that the carriers of the invention provided better charge stability after exercising, less admix dust and better stability with humidity change.

EXAMPLE 7

In this example the carriers were prepared and tested as in Example 1 and the silicone coatings for the carriers of the invention contained alkali metal salts of polymeric acids.

TABLE 5

| Sample # & Additive | Age of Carrier | Fresh Q/M | 10 Min. Ex. Q/M | 15 Sec. Admix Dust 12%–18% T.C. (mg) | 10% R.H.–80% R.H. ΔQ (μ Coul.) |
|---|---|---|---|---|---|
| 61–1 (Control) | Fresh | −22.2 | −27.6 | 7.5 | 8.7 |
| | O.N. | −16.3 | −19.9 | 15.2 | N.R. |
| 61–2* | Fresh | −9.2 | −15.4 | 5.4 | 2.6 |
| 1.17% Fumaric Acid Di Na Salt | O.N. | −13.9 | −16.7 | 7 | N.R. |
| 61–3* | Fresh | −9.2 | −18.4 | 5.3 | 1.4 |
| 1.3% Malic Acid Di Na Salt | O.N. | −14.7 | −16.3 | 7 | N.R. |
| 61–4* | Fresh | −13 | −20.2 | 4.4 | 0.9 |
| 0.7% Na Propionate | O.N. | −15.3 | −18.7 | 9.9 | N.R. |
| 61–5* | Fresh | −13.8 | −17.7 | 4.7 | 6.6 |
| 0.945% Lactic Acid K Salt | O.N. | −14.6 | −18.2 | 7.6 | N.R. |
| 61–6* | Fresh | −15.2 | −18 | 3.5 | 7.2 |
| 0.84% Glycolic Acid K Salt | O.N. | −16 | −18.2 | 6.8 | N.R. |
| 70–7* | Fresh | −18.2 | −21.9 | 3.8 | 3.2 |
| 1.22% Na Octanoate | O.N. | −16 | −19.9 | 6.8 | N.R. |
| 70–9 | Fresh | −13.8 | −20.8 | 5.3 | 2 |
| 1.39% EDTA Na4 X H2O | O.N. | −13.1 | −16.6 | 6.3 | N.R. |
| 70–11* | Fresh | −16.3 | −21.5 | 5.5 | 6.2 |
| Glycine Na Salt X H2O | O.N. | −14.3 | −17.5 | 9.9 | N.R. |
| 70–12* | Fresh | −15.9 | −19.6 | 6.3 | 1.1 |
| 1.37% Glutamic Acid Mono Na Salt H2O | O.N. | −14.6 | −18 | 9.3 | N.R. |
| 82–11 | Fresh | −12 | −22 | 4.7 | 1.5 |
| 1.08% Na Citrate | O.N. | −12 | −15.7 | 6.3 | N.R. |

*Equimolar to 0.6% Na Acetate

EXAMPLE 6

In this example the coatings of the invention contained aromatic acid salts, including sulfonic acid salts. The tests other than the 10–80% R.H. test were run at 20–25% R.H.

TABLE 6

| Sample # & Additive | Fresh Q/M | 10 Min. Ex. Q/M | 15 Sec. Admix Dust 12%–18% T.C (mg) | 10% R.H.–80% R.H. ΔQ (μ Coul.) |
|---|---|---|---|---|
| 28–1 (Control) | −22.3 | −30.1 | 14.7 | 8.8 |
| 28–5* 1.77% Di K Phthalate | −18.8 | −19.7 | 4.6 | 5.8 |
| 28–6* 1.54% Di Na Terephthalate | −19.1 | −20.6 | 5.6 | 6.2 |
| 28–7* 1.32% Na Benzene Sulfonate | −18.5 | −23.7 | 4.4 | 5.8 |
| 28–8* 2.1% Di-Na 1,3Benzene Disulfonate | −13.4 | −16.8 | 9.4 | 5.2 |
| 19–3* 1.42% Na p-Toluenesulfonate | −17.9 | −24.9 | 7.6 | 2.8 |

*Equimolar with 0.6% Na Acetate

TABLE 7

| Sample # & Additive | Fresh Q/M | 10 Min. Ex. Q/M | 15 Sec. Admix Dust 12%–18% T.C. (mg) | 10% R.H.–80% R.H. ΔQ (μ Coul.) |
|---|---|---|---|---|
| 1–1 (Control) | −24.8 | −32.2 | 11.3 | 8.4 |
| 4–10 0.6% Polyacrylic Acid | −14.5 | −23.9 | 28.5 | 8.3 |
| 1–6 0.6% Polyacrylic Acid Na Salt | −18.6 | −18.2 | 10.1 | 3.3 |
| 1–7 0.6% Polymethacrylic Acid Na Salt | −17.6 | −17.9 | 8.2 | 6.7 |
| 40–8 3.4% Polyvinylchlorendate K Salt | −6.2 | −7.4 | 15.9 | 0.9 |
| 60–2 1.19% Polyvinylsulfate K Salt | −16 | −21.4 | 7.6 | 5.9 |
| 18–6 0.6% Poly(Styrenesulfonic Acid -co-Maleic Acid 1:1) Na Salt | −15.8 | −18.4 | 10.7 | 6 |

Table 7 shows that with polyacrylic acid, the charging rate, as evidenced by admix dust or toner throw-off, was much worse than with the corresponding Na salt. The throw off for the polyvinylchlorendate K salt was slightly higher than the control but this was due to its very low charge. This salt, however, works well to prevent humidity sensitivity, as shown in the table.

EXAMPLE 8

In this example the alkali metal salt was generated by adding a colloidal silica containing an alkali metal oxide as a stabilizer; and depending upon the acid used; the alkali metal acetate, formate, etc. was generated, resulting in improvement in charging rate and a lowering of the humidity sensitivity as described in the previous examples. A silicone resin coated carrier sample, prepared in acetic acid, to which a colloidal silica stabilized with sodium oxide was added, showed the presence of sodium acetate when extracted with methyl alcohol. Table 8 shows the effect of the addition of potassium carbonate and potassium hydroxide to a silicone resin coating prepared in acetic acid.

TABLE 8

| Sample # & Additive | Fresh Q/M | 10 Min. Ex. Q/M | 15 Sec. Admix Dust 12%–18% T.C. (mg) | 10% R.H.–80% R.H. ΔQ (μ Coul.) |
|---|---|---|---|---|
| 1–1 (Control) | −22.4 | −27.9 | 15.2 | 10.2 |
| 95–1 & 0.5% K2CO3 | −13.8 | −19 | 6 | 5.4 |
| 84–6 & 1.0% K2CO3 | −7.5 | −20.6 | 4.3 | 1.1 |
| 95–12 & 0.5% KOH | −13 | −20.2 | 5.4 | 4 |

EXAMPLE 9

Carriers of the invention having coatings containing sodium tartaric acid salts were compared with a control carrier as in the previous examples. As shown in Table 9, the carriers of the invention provided charge stability after exercising, low throw off and charge stability with humidity changes.

TABLE 9

| Sample # & Additive | Aging | Q/M | 10 Min. Ex. Q/M | 15 sec. Admix Dust 12%–18% TC (mg.) | 10%–80% R.H. ΔQ (μ Coul.) |
|---|---|---|---|---|---|
| 70–1 | Fresh | −21.9 | −28.3 | 9.7 | 8.7 |
| CONTROL | O.N. | −16 | −19.9 | 17.9 | |

TABLE 9-continued

| Sample # & Additive | Aging | Q/M | 10 Min. Ex. Q/M | 15 sec. Admix Dust 12%–18% TC (mg.) | 10%–80% R.H. ΔQ (μ Coul.) |
|---|---|---|---|---|---|
| 70–3 | Fresh | −12.9 | −16.2 | 7 | 3.9 |
| 1.68% Na Tartrate 2H2O | O.N. | −13.5 | −16.1 | 7.5 | |
| 176–8 | Fresh | −12 | −12.8 | 4.6 | 1 |
| 2.065% Na K Tartrate 4H2O | O.N. | −11.9 | −16.1 | 4.9 | |

Although the invention has been described in detail with particular reference to certain preferred embodiments thereof, it should be appreciated that variations and modifications can be effected within the spirit and scope of the invention.

What is claimed is:

1. An electrostatographic developer carrier composition comprising carrier core particles having a coating comprising a silicone resin admixed with an alkali metal salt of organic acid.

2. A carrier composition of claim 1 wherein said acid is a carboxylic or sulfonic acid.

3. A carrier composition of claim 1 wherein said acid is a monocarboxylic aliphatic acid of 1 to 8 carbon atoms.

4. A carrier composition of claim 2 wherein said acid is a polybasic carboxylic or sulfonic acid.

5. A carrier composition of claim 2 wherein said silicone resin is a hydrolyzed copolymer of alkylalkoxy silanes.

6. A carrier composition of claim 1 wherein said carrier core particles are magnetic particles.

7. A carrier composition of claim 6 wherein said carrier core particles are ferrite particles.

8. A carrier composition of claim 7 wherein said carrier core particles are strontium ferrite particles.

9. A method of making carrier particles for an electrostatographic developer composition which comprises hydrolyzing an alkoxy-substituted silane in an acid solution and polymerizing the hydrolyzed silane in said solution, adding to and admixing with said solution an alkali metal compound, adding developer carrier core particles to said solution to form on said core particles a silicone coating containing an alkali metal salt of an organic acid, drying the coated particles and heating the dried particles sufficiently to cure the silicone coating containing said alkali metal salt of an organic acid.

10. The method of claim 9 wherein a mixture of alkoxy silanes is hydrolyzed and a silicone copolymer is formed.

11. The method of claim 10 wherein said mixture comprises alkylalkyoxy silanes.

12. The method of claim 9 wherein said alkali metal compound is an alkali metal salt of an organic acid.

13. The method of claim 9 wherein said acid solution comprises a mixture of alkali metal organic acid salts.

14. The method of claim 9 wherein said organic acid is a monocarboxylic aliphatic acid of 1 to 4 carbon atoms.

15. The method of claim 9 wherein said acid solution contains an organic acid and said alkali metal compound reacts with said organic acid to form in situ an alkali metal salt of an organic acid.

16. The method of claim 9 wherein said core particles are strontium ferrite particles.

17. An electrostatographic developer composition comprising carrier particles and toner particles, wherein said carrier particles comprise carrier cores coated with a cross-linked silicone resin admixed with an alkali metal salt of an organic acid and wherein said toner particles comprise an insulative binder polymer.

18. A developer composition of claim 17 wherein said carrier cores comprise a ferrite and said toner particles comprise a thermoplastic, insulative, styrene-butylacrylate-divinyl benzene copolymer.

19. A developer composition of claim 18 wherein said carrier cores comprise strontium ferrite having a silicone coating that contains an alkali metal salt of a carboxylic acid.

20. A developer composition of claim 17 wherein said silicone coating comprises a silicone resin formed from silanes having the formula:

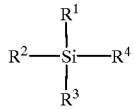

wherein $R^1$, $R^2$, $R^3$ and $R^4$ are independently selected hydrolyzable or non-hydrolyzable moieties, with the proviso that at least 70% of the total number of said silanes have three hydrolyzable moieties and the remaining silanes have at least one hydrolyzable moiety.

21. A developer composition of claim 20 wherein said silicone coating is formed from silanes selected from the group consisting of alkyltrialkoxysilanes, dialkyldialkoxysilanes, trialkylalkoxysilanes, tetraalkoxysilanes, aryltrialkoxysilanes and halosilanes.

22. A developer composition of claim 19 wherein said silicone resin is admixed with an alkali metal salt of a carboxylic or sulfonic acid.

* * * * *